US006364060B1

(12) United States Patent
Cherry

(10) Patent No.: US 6,364,060 B1
(45) Date of Patent: Apr. 2, 2002

(54) LOW PROFILE LIFT ASSEMBLY

(75) Inventor: Charles W. Cherry, Edmond, OK (US)

(73) Assignee: Autoquip Corporation, Guthrie, OK (US)

( * ) Notice: Subject to any disclaimer, the term of this patent is extended or adjusted under 35 U.S.C. 154(b) by 0 days.

(21) Appl. No.: 09/579,830

(22) Filed: May 26, 2000

(51) Int. Cl.[7] ..... B66F 7/00
(52) U.S. Cl. ..... 187/203
(58) Field of Search ..... 187/203, 210, 187/211, 215, 240, 242, 243, 244, 269

(56) References Cited

U.S. PATENT DOCUMENTS

| | | | | |
|---|---|---|---|---|
| 4,753,419 A | | 6/1988 | Johansson | 254/122 |
| 4,804,068 A | | 2/1989 | Carter | 254/8.72 |
| 4,848,732 A | | 7/1989 | Rossato | 254/90 |
| 5,035,562 A | * | 7/1991 | Rosen | 414/240 |
| 5,040,637 A | | 8/1991 | Hawk | 187/8.5 |
| 5,050,844 A | | 9/1991 | Hawk | 254/89 H |
| 5,370,493 A | | 12/1994 | Oshima | 414/556 |
| 5,727,655 A | | 3/1998 | Pitman | 187/211 |
| 5,829,948 A | * | 11/1998 | Becklund | 414/607 |
| 5,848,668 A | * | 12/1998 | Kafrissen et al. | 187/231 |
| 5,887,680 A | | 3/1999 | Carson et al. | 187/240 |

* cited by examiner

*Primary Examiner*—Christopher P. Ellis
*Assistant Examiner*—Kenneth W Bower
(74) *Attorney, Agent, or Firm*—John W. Harbst

(57) ABSTRACT

A low profile lift apparatus including a lift platform which accommodates manufactured product on a support surface thereof and elevationally lifts the manufactured product to a vertical level or elevation generally coplanar with an elevated surface on an adjacent pallet is disclosed. The low profile lift apparatus includes a base adapted to rest on a floor with the lift platform interconnected to the base for movement between raised and lowered positions. In a lowered position, a lower surface of the lift platform rests on the floor to provide the lift assembly with a low profile. The lift apparatus of the present invention further includes an apparatus for moving the platform relative to said base. Such apparatus preferably includes circuitry for selectively moving the lift platform in a controlled fashion relative to the base.

20 Claims, 5 Drawing Sheets

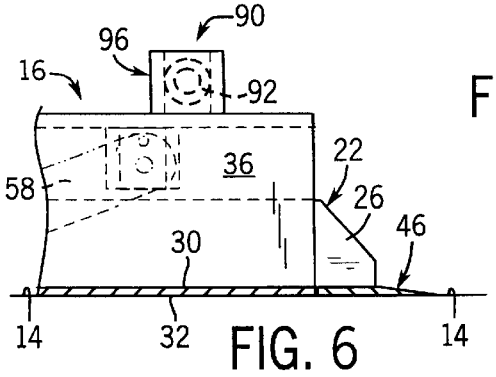
FIG. 6
FIG. 8
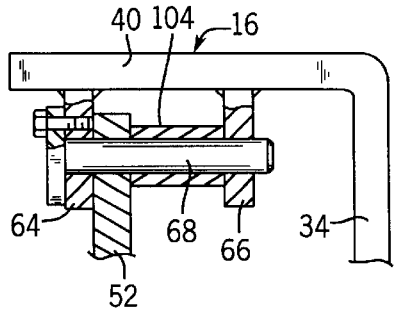
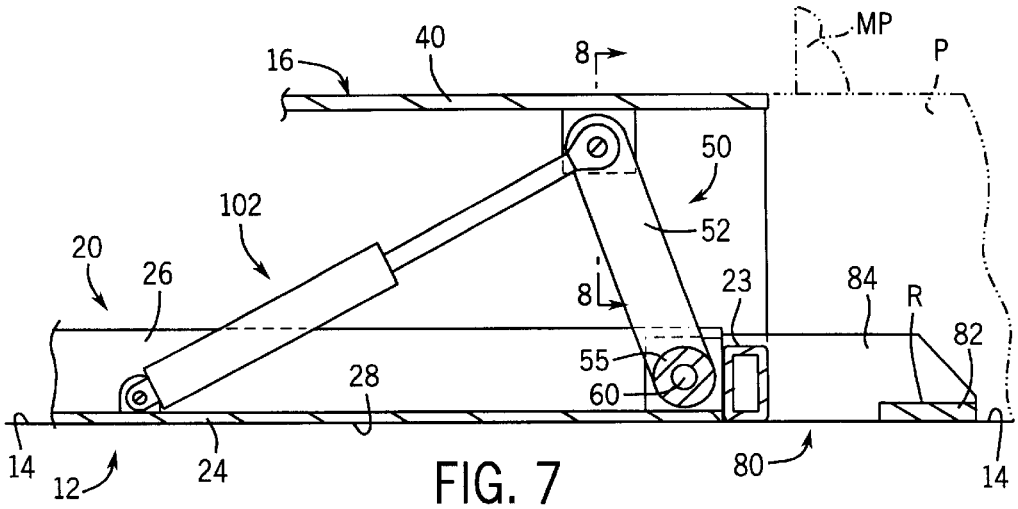
FIG. 7
FIG. 9
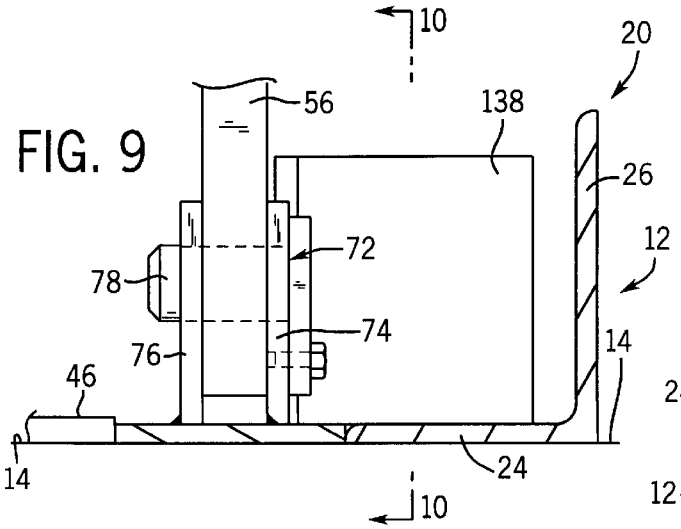
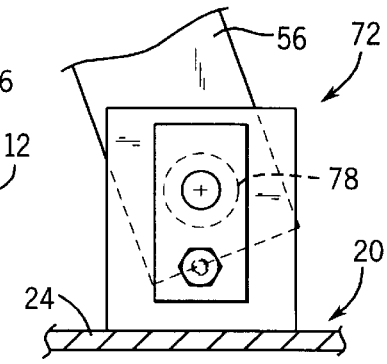
FIG. 10

LOW PROFILE LIFT ASSEMBLY

FIELD OF THE INVENTION

The present invention generally relates to lift assemblies and, more particularly, to an assembly used to position articles supported on a lift platform at a suitable elevation allowing for such articles to be readily and easily transferred to a pallet arranged adjacent to the lift assembly.

FIELD OF THE INVENTION

In rolling stock warehouses, manufactured product is typically wrapped and stored on wooden pallets. That is, larger machines such as high-volume photocopiers, large format printers and plotters, high output imagers, mainframe computers, and a myriad of other devices are assembled, placed onto pallets and stored until needed. Similarly, small to mid-range machines such as mid-volume copiers, convenience copiers, printers and fax machines on wheels, wheeled tool boxes, picking carts, trade show cases and other manufactured equipment and products are assembled, placed onto pallets and stored in warehouses until sold. Placing or loading such manufactured product onto pallets readily allow a fork lift or other conventional lifting device to be inserted beneath an elevated support surface of the pallet thereby lifting the entire pallet and transporting the manufactured product thereon to a suitable location for storage.

Newer pallet technology readily allows wheeled manufactured products to be suitably secured to the pallet with relative ease thereby preventing the product from rolling off during loading or while in transport. Some newer pallets furthermore allow the wheels on such manufactured product to nest or be seated within suitable recesses provided on the upper support surface of the pallet.

As will be appreciated, and besides being expensive, such manufactured product is often quite heavy. Accordingly, an inclined or ramped surface is normally required to allow the product to be pushed or rolled up and onto the elevated support surface of the pallet rather than manually lifted onto the pallet's upper support surface. Of course, the ramp must be elongated in length so as to gradually allow the difference in height between the floor and the elevated support surface of the pallet to be overcome, especially as the manufactured product is being loaded onto the pallet.

When pushing the manufactured product up the incline or ramp to the elevated support surface of the pallet, a significant degree of care must also be exercised over the lateral disposition of the product. If the wheeled product inadvertently rolls off the ramp during its movement toward the elevated support surface of the pallet, the product may tumble and fall, thus, resulting in significant damage to the manufactured product. Collateral damage could also be incurred by the person or persons pushing the wheeled product toward the pallet. Moreover, if the person or persons pushing the product up the incline or ramp should slip or fall, the manufactured product will naturally tend to roll down the ramp which could cause significant damage to the person or person lying in the path of such wheeled product and to the product itself.

A sharply inclined ramp could likewise prove detrimental when unloading the manufactured product from the pallet unless care is exercised over the unloading process. Of course, if the manufactured product is not controlled during its descent from the elevated support surface of the pallet, significant damage can result to the product. In those instances where the manufactured product involves highly technical components, such as high-speed or high volume copiers or the like, relatively simple jarring motions can result in significant damage to what is a relatively expensive manufactured product. Accordingly significant care must be exercised during both during loading and loading of the manufactured product.

Besides the above-identified problems, such ramps or inclined structures consume valuable floor space. As mentioned, such ramps or inclined surfaces must be elongated in length so as to gradually allow the difference in height between the floor and the elevated support surface of the pallet to be overcome, especially as the manufactured product is being loaded onto the pallet. In some warehouses or facilities where the wheeled manufactured product is initially loaded onto the pallet, space is a premium. Accordingly, such ramps are often shortened, thus, significantly increasing the effort required to load and unload the wheeled manufactured product from the support surface of the palletized structure. Of course, a shortened length for the ramp or incline furthermore exacerbates the control problems required to be diligently exercised over the manufactured product as it moves up and down the incline relative to the elevated support surface on the pallet.

Thus, there is a continuing need and desire for a low profile lift apparatus which overcomes the heretofore known problems with loading and unloading of wheeled manufactured product from an elevated support surface of a pallet structure while allowing complete control to be exerted during the transference of the wheeled manufactured product between the floor and the elevated support surface of the pallet.

SUMMARY OF THE INVENTION

In view of the above, and in accordance with the present invention, there is provided a low profile lift apparatus including a lift platform which accommodates manufactured product on a support surface thereof and vertically lifts or raises the manufactured product to a level or elevation generally coplanar with an elevated surface on an adjacent pallet thereby promoting transference of the product from the lift platform to the support surface on the pallet. More specifically, the low profile lift apparatus of the present invention includes a base adapted to rest on a floor with the lift platform interconnected to the base for vertical movements between raised and lowered positions. In a lowered position, a lower surface of the lift platform rests on the floor to provide the lift assembly with a low profile. The lift apparatus of the present invention further includes an apparatus for vertically moving the lift platform relative to said base.

The support surface on the lift platform and the lower surface of the lift platform are vertically spaced from each other as by the material thickness of the lift platform. In a preferred form of the invention, the lift assembly of the present invention further includes a ramp leading from the floor to the upper surface of the lift platform for facilitating movement of wheeled manufactured product from the floor to the lift platform and over the material thickness of the lift platform. Of course, the thickness of the lift platform is not that great. Accordingly, the ramp for facilitating movement of wheeled manufactured product from the floor to the lift platform is relatively short. In a most preferred form of the invention, such ramp is connected to and forms part of the lift assembly base.

The lift platform is preferably configured to inhibit inadvertent lateral shifting of the wheeled manufactured product supported thereon beyond predetermined lateral limits. The support surface of the lift platform has a generally planar configuration which is generally horizontally disposed. In a preferred form, the lift platform has a generally rectangular configuration and further includes two vertically upstanding sides extending along opposite sides of the platform and which combine with the support surface to provide the lift platform with an open top channel into which the wheeled manufactured product is accommodated. The sides of the lift platform limit lateral movements of the product supported on the lift platform.

In a preferred form of the invention, the lift assembly is structured to inhibit inadvertent shifting movements between the lift assembly and the adjacent pallet onto which the manufactured wheeled product is to be placed or loaded. In a most preferred form, the lift platform is furthermore provided with structure for limiting horizontal movements of the product carried on the support surface from falling from an open end of the channel defined by the lift platform. In one position, such limiting structure is preferably configured to extend laterally across at least one end of the open top channel formed by the lift platform. In another position, such limiting structure is disposed to facilitate rolling movements of the manufactured product from either end of the lift platform.

A linkage assembly operably interconnects the base with the lift platform. In a preferred form, the linkage is configured to maintain the support surface of the lift platform in generally parallel relation relative to the floor as the lift platform moves between lowered and raised positions. Preferably, four swing arms form the linkage assembly. Each swing arm is pivotally interconnected at opposite ends and to the same side of the base and the lift platform. Such swing arms are preferably all of equal length.

The apparatus for vertically moving the platform relative to said base preferably includes a pair of drivers operably connected between the base and the lift platform. The apparatus for vertically moving the lift platform relative to the base preferably furthermore includes circuitry which is selectively controlled by an operator to raise and lower the lift platform relative to the base. Such circuitry preferably includes a sensor for effecting movement of the platform relative to the base of the lift assembly.

As will be appreciated from the above, a primary object of this invention is to provide a low profile lift assembly for elevating manufactured products from floor level to a raised level substantially coplanar with an upper surface of a pallet thereby promoting transference of the product from the lift assembly to the pallet.

Another object of this invention is to controllably change the elevation of manufactured product within minimum space constraints thereby facilitating transference of manufactured product from floor level to a height substantially level with an upper support surface of a pallet.

Still another object of this invention is to vertically move manufactured product from a floor level disposition to a raised disposition extending substantially coplanar with an upper surface of a pallet while controlling inadvertent movements of the manufactured product which could result in damage being incurred thereto.

These and other objects, aims and advantages of the present invention will become more readily apparent from the following detailed drawings, the description and the appended claims.

DETAILED DESCRIPTION OF THE DRAWINGS

FIG. 6 is an enlarged sectional view taken along line 6—6 of FIG. 4;

FIG. 7 is a sectional view taken along line 7—7 of FIG. 4;

FIG. 8 is a sectional view taken along line 8—8 of FIG. 7;

FIG. 9 is a sectional view taken along line 9—9 of FIG. 4;

FIG. 10 is a sectional view taken along line 10—10 of FIG. 9;

DETAILED DESCRIPTION OF THE PRESENT INVENTION

Figure 1:
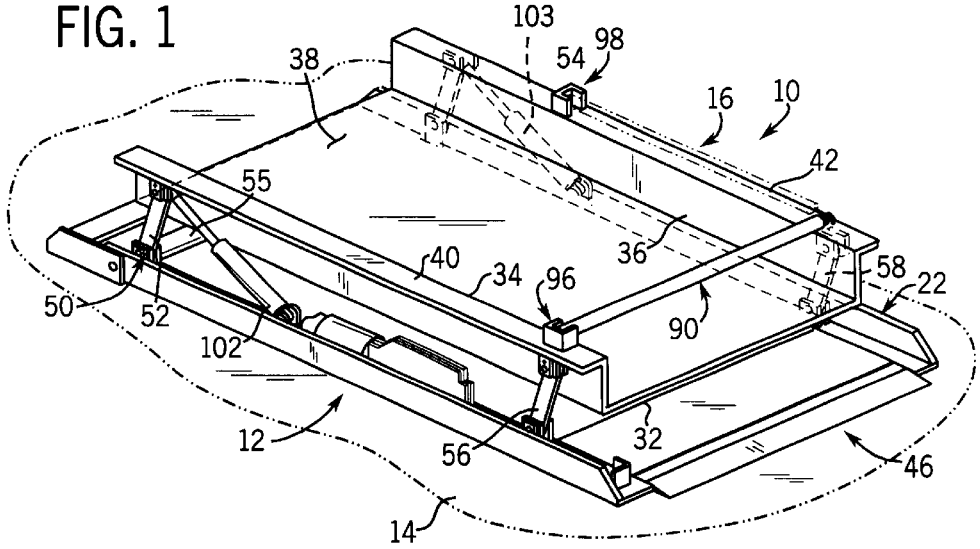
FIG. 1 is a perspective view of one embodiment of a low profile lift assembly according to the present invention.

While the present invention is susceptible of embodiment in various forms, there is shown in the drawings and will hereinafter be described a preferred embodiment of the invention with the understanding the present disclosure is to be considered as setting forth only an exemplification of the invention which is not intended to limit the invention to the specific embodiment illustrated.

Figure 2:
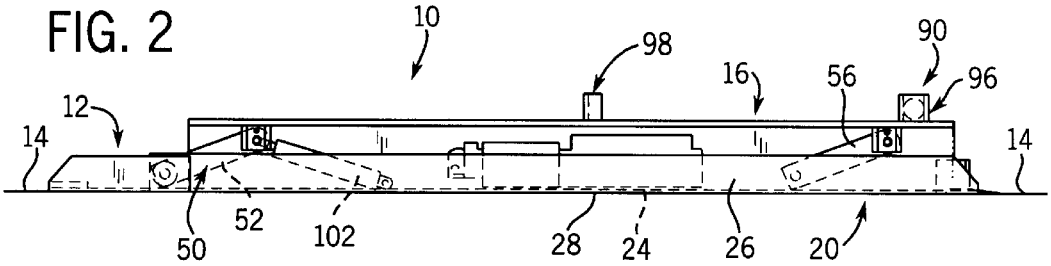
FIG. 2 is a side elevational view of the lift assembly of the present invention with a lift platform thereof in a lowered position.
Figure 3:
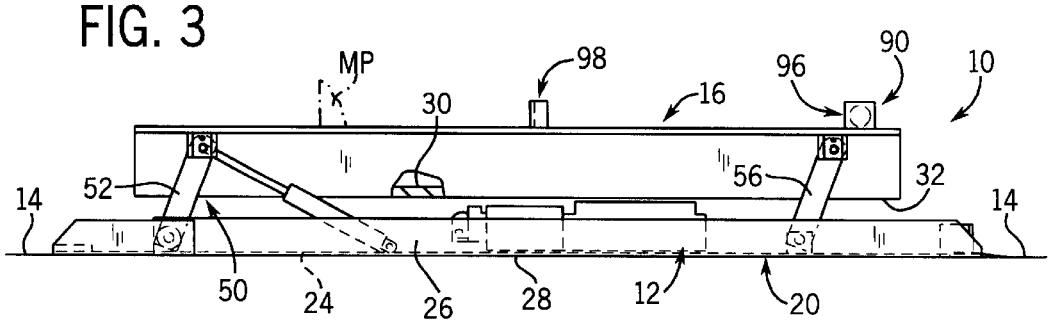
FIG. 3 is a side elevational view of the lift assembly of the present invention with a lift platform thereof in a raised position.

Referring now to the drawings, wherein like reference numerals indicate like parts throughout the several views, there is schematically represented in FIG. 1 a low profile lift assembly generally indicated by reference numeral 10. The lift assembly 10 includes a base 12 which is intended to rest on a floor 14 and a lift platform 16 interconnected and movable between a lowered elevational position, as illustrated in FIG. 2, and a raised elevational position, as illustrated in FIG. 3. Notably, in the illustrated embodiment, the range of elevational travel of the lift platform 16 relative to the base 12 is between about 5 inches and about 7 inches. In the most preferred form of the invention, the elevational travel of the lift platform 16 relative to the base 12 is about 6.312 inches.

Figure 4:
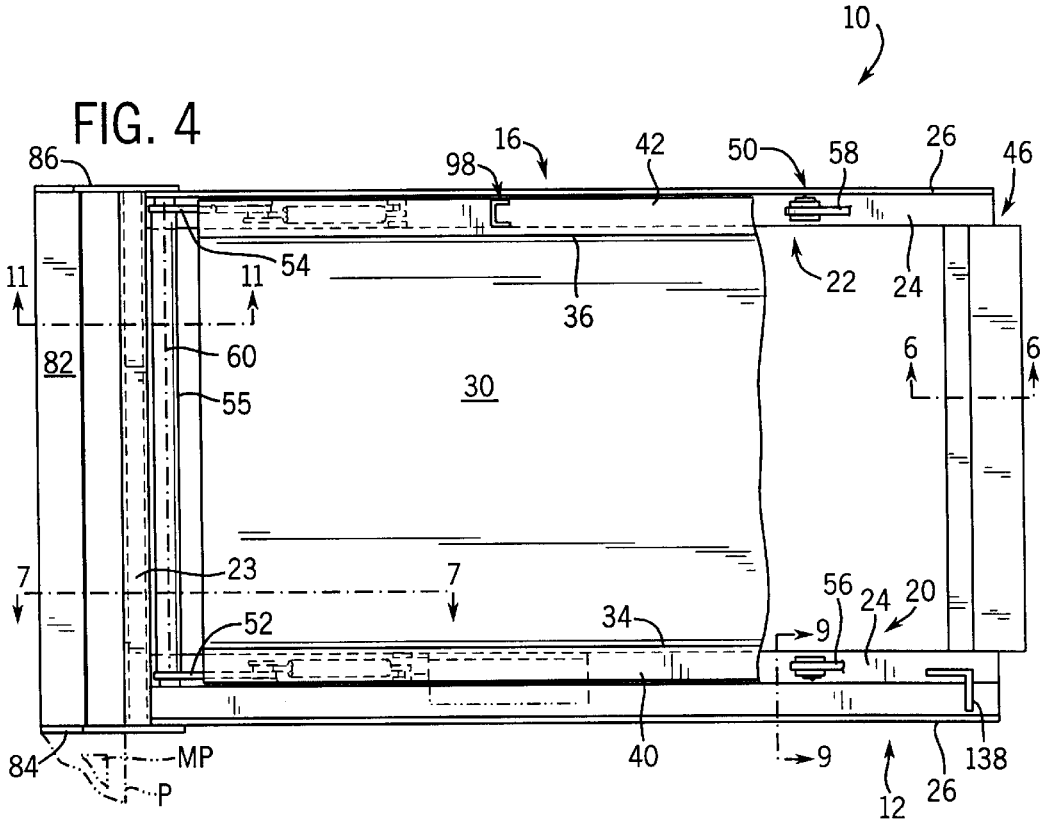
FIG. 4 is a top plan view, with parts broken away, of the lift assembly of the present invention.
Figure 5:
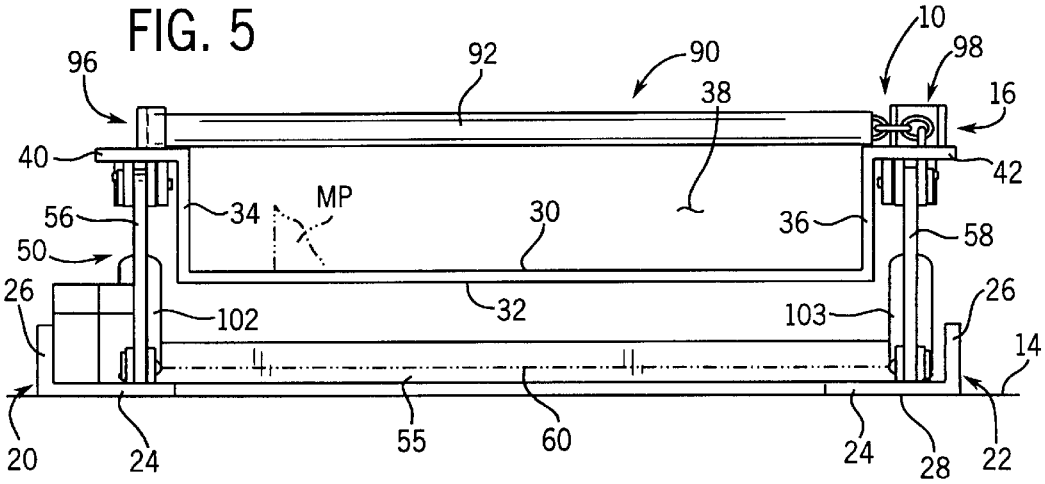
FIG. 5 is an end view of the lift assembly of the present invention.

Base 12 is disposed beneath the lift platform 16 of the lift assembly 10 and preferably includes two generally parallel and laterally spaced elongated ground or floor engaging members 20 and 22. In the preferred embodiment, each member 20, 22 is configured as an L-shaped rail including two angularly diverging legs 24 and 26. The leg 24 of each rail 20, 22 is arranged in generally coplanar relation relative to each other to define a ground engaging support surface 28 for the base 12. Leg 26 of each rail 20, 22 is disposed in a generally vertical direction or orientation. As illustrated in FIGS. 1, 4 and 5, the members or rails 20, 22 define a predetermined lateral distance therebetween. In a preferred form, an elongated structural member 23 (FIG. 4) interconnects and maintains the base members 20, 22 with the predetermined lateral spacing therebetween. To reduce the overall weight of the lift assembly, the structural member 23 preferably has an elongated tubular configuration.

The lift platform 16 of the lift assembly has an upper generally horizontal and preferably planar support surface 30 and a lower surface 32. Notably, the lift platform 16 is fabricated from sturdy material capable of supporting manufactured products MP of significant weight thereon without bending or substantially deflecting from the original fabricated shape thereof As illustrated in FIGS. 5 and 6, the upper support surface 30 of the lift platform 16 and the lower surface 32 are vertically separated by the thickness of the material forming the lift platform 16. It is important to note, the configuration of the lift platform 16 is such that the lift platform 16 fits or is vertically accommodated between the laterally spaced members 20, 22 of base 12. Suffice it to say, when the lift platform 16 of the lift assembly 10 is in a lowered position, the lower surface 32 of the platform 16 rests on the floor or ground 14 whereby providing the lift assembly 10 of the present invention with a low profile.

As illustrated in FIGS. 1 and 4, the lift platform 16 has a generally rectangular configuration. In the preferred embodiment, the lift platform 16 further includes vertical sides 34 and 36 which are laterally spaced from one another and add rigidity to the platform 16. In the illustrated embodiment, the sides 34 and 36 extend longitudinally along opposed sides of the support surface 30 and are substantially coextensive therewith. As shown, the sides 34 and 36 of the lift platform 16 are arranged in upstanding relation relative to the upper surface 30 of the lift platform 16 and, in combination therewith, define an open top channel 38 opening at opposite ends thereof As will be appreciated from an understanding thereof, the vertical sides 34 and 36 inhibit the manufactured product supported by and loaded onto the lift platform 16 from shifting or rolling laterally beyond predetermined limits defined by the vertical sides 34 and 36 of the lift platform 16.

In the embodiment illustrated in FIGS. 1, 4 and 5, the lift platform 16 is furthermore provided with flanges or extensions 40 and 42 extending generally horizontally and outwardly from upper extremes of the each side 34 and 36, respectively. As shown, the flanges or extensions 40, 42 extend along the length of the sides 34, 36 and are disposed generally parallel to the upper support surface 30 of the lift platform 16. The lift platform 16 is designed and fabricated such that the flanges or extensions 40, 42 remain rigid and in the disposition extending generally parallel relative to the upper support surface 30 of the lift platform 16 throughout operation of the lift assembly 10.

As illustrated in FIG. 6, and as discussed above, when the lift platform 16 is in a lower position, the lower surface 32 of the lift platform 16 engages the ground or floor 14 on which the lift assembly 10 is located. Even though the lower surface 32 of the lift platform 16 engages the ground or floor 14, the material thickness of the lift platform 16 presents an obstacle which must be overcome when rolling or wheeled manufactured product or articles from the floor or ground 14 to the upper support surface 30 of the platform 16.

To facilitate movement of articles, such as rolling or wheeled manufactured product, from the floor or ground 14 to the upper surface 30 of the lift platform 16, a preferred form of lift assembly 10 further includes a ramp or inclined surface 46 leading from the floor or ground 14 to the upper surface 30 of the lift platform 16. In the illustrated form, the lift platform 16 is fabricated from a suitable metal product, i.e., steel, or the like, and has a material thickness ranging between about 0.312 inches and about 0.750 inches. In a desired form, the material thickness of the lift platform 16 measures about 0.500 inches. Accordingly, and as will be appreciated, the width of the incline or ramp 46 leading from the floor or ground 14 to the upper surface 30 of the lift platform 16 can be relatively short and, thus, not significantly increasing the overall length of the lift assembly 10. Although the width of the ramp or incline 46 may be relatively small, such ramp or incline 46 nevertheless operably effects a smoother transition from the floor 14 to the upper surface 30 of the lift platform than if the wheeled manufactured product had to be forcibly moved onto the lift platform 16 by forcibly pushing the wheels of the manufactured product over the material thickness of the lift platform 16. In a most preferred form, the incline or ramp 46 is located between and attached toward opposite ends to the legs 24 of the members or rails 20, 22 of base 12.

A linkage assembly 50 operably interconnects the base 12 to the lift platform 16. In the illustrated form, the linkage assembly 50 maintains the supporting surface 30 of the lift platform 16 in generally parallel relation relative to the base 12 and the floor 14 on which the base 12 rests. As will be appreciated by those skilled in the art, the linkage assembly 50 for interconnecting the base 12 and the lift platform 16 can take a myriad of designs without detracting or departing from the spirit and scope of the present invention. In a preferred form, linkage assembly 50 includes first, second, third and fourth swing arms 52, 54, 56 and 58, respectively.

As illustrated in FIG. 4, the first and second swings arms 52 and 54, respectively, are arranged in laterally spaced relation and operate in tandem relative to each other toward one end of the base 12 and lift platform 16. According to the preferred arrangement, and for purposes described in detail hereinbelow, a sturdy torsion bar 55 interconnects the lower end of the first and second swing arms 52 and 54, respectively. Similarly, the third and fourth swing arms 56 and 58, respectively, are arranged in laterally spaced relation and operate in tandem relative to each other toward another end of the base 12 and the lift platform 16. In the illustrated form, the swing arms 52, 54, 56 and 58 are substantially identical in length relative to each other.

As illustrated in FIGS. 4 and 7, the swing arms 52 and 54 of linkage assembly 50 are each pivotally connected toward a lower end to the base 12 of the lift assembly for rotation about a fixed axis 60. Preferably, the swing arms 52, 54 are each pivotally attached to the second or vertical leg 26 of the rail or base member 20, 22 arranged in adjacent relation relative thereto. As illustrated in FIGS. 7 and 8, the swing arm 52 is pivotally connected toward an upper end thereof to the lift platform 16.

As shown in FIGS. 7 and 8, a clevis 62 preferably including laterally spaced arms 64 and 66 depends from the flange or extension 40 on the lift platform 16. The swing arm 52 is embraced by the arms 64 and 66 of the clevis 62 and a pivot pin or stub shaft 68 projects through the arms 64, 66 of the clevis 62 and through the free end of swing arm 52 thereby pivotally connecting the swing arm 52 to the lift platform 16. As will be appreciated, and without going into specific detail, an upper end of swing arm 54 is similarly connected to the flange or extension 42 on the opposite side of the lift platform 16.

Each swing arm 56, 58 is pivotally connected toward a lower end thereof to the base 12 of the lift assembly 10. The connection for each swing arm 56, 58 to the base 12 of the lift assembly is substantially the same. Accordingly, the pivotal connection of only swing arm 56 to the base 12 of the lift assembly will be described in detail. As shown in FIGS. 9 and 10, a clevis 72 preferably including laterally spaced arms 74 and 76 upwardly projects from the leg 24 of the rail or base member 20. The lower end of swing arm 56 is embraced by the arms 74 and 76 of the clevis 72 and a pivot pin or stub shaft 78 projects through the arms 74, 76 of the clevis 72 and through the lower end of swing arm 56 thereby pivotally connecting the swing arm 56 to the base 12. Structure similar to that discussed above is provided at the opposite end for pivotally connecting an upper end of each swing aim 56, 58 to the lift platform 16.

As will be appreciated by those skilled in the art, and when disposed for operation, the lift assembly 10 of the present invention is arranged adjacent to one end or side of a pallet P onto which the manufactured product MP is to be loaded. In a preferred form, the lift assembly 10 is furthermore configured to maintain the lift assembly 10 and the pallet P in prearranged relation to each other while inhibiting inadvertent shifting movements of the lifting assembly 10 relative to the pallet P.

Figure 11:
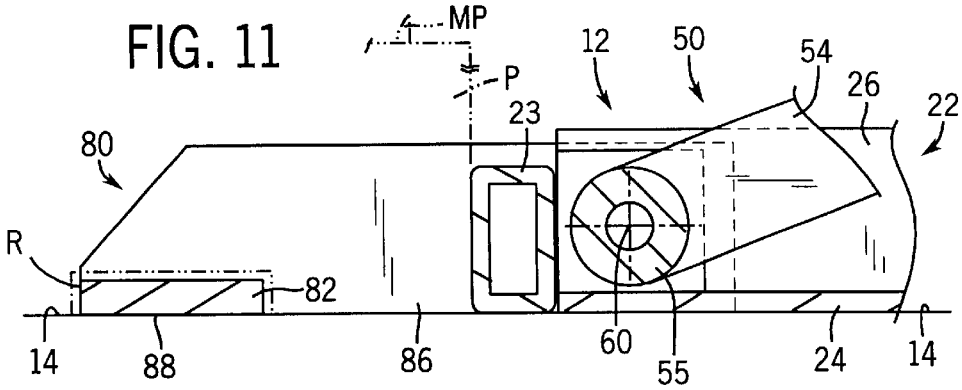
FIG. 11 is a sectional view taken along line 11—11 of FIG. 4

As indicated in FIGS. 4, 7 and 11, structure 80 extends from that end of the base 12 opposite from the ramp or incline 46 for maintaining the lift assembly 10 in prearranged relation relative to the pallet P on which the manufactured product MP is to be positioned or loaded. As shown, structure 80 preferably includes a laterally elongated plate 82 which is horizontally spaced from the base 12 by a predetermined distance. In the illustrated embodiment, a pair of rigid arms 84 and 86 extend endwise from the members 20 and 22, respectively, of the base 10 of the lift assembly 10 so as to maintain the predetermined distance between the plate 82 and the base 12. Notably, a lower surface 88 of the plate 82 is arranged generally coplanar with the ground engaging support surface 28 defined by the base members 20 and 22.

As schematically represented in FIGS. 7 and 11, the plate 82 of structure 80 is configured to be accommodated within a conventional open bottom slot or recess R provided on the pallet P when the pallet P and the lift assembly 10 of the present invention are arranged in operable combination relative to each other. As will be readily appreciated by those skilled in the art, the limits of the recess R serve to entrap the plate 82 therewithin, thus, inhibiting inadvertent horizontal shifting movements of the lifting assembly 10 relative to the pallet P.

As indicated above, the lift platform 16 defines an open ended channel 38 between the support surface 30 and the sides 34 and 36 thereof. As will be appreciated from an understanding of the present invention, the open ends of the lift platform 16 allow the manufactured product MP to be rolled onto the lift platform 16 at one end and rolled off the lift platform 16 and onto the elevated support surface of the pallet P at the other end.

According to another aspect of the invention, the lift assembly 10 is provided with structure 90 for inhibiting inadvertent horizontal movements of the articles such as the manufactured product MP from at least one end of the lift platform 16. In the illustrated embodiment, structure 90 includes an elongated bar 92 which extends above the upper support surface 30 and across the open end of the lift platform 16 opening to the elevated support surface of the pallet P to limit horizontal movements of articles or manufactured product therepast.

In a preferred form, the bar 92 is hingedly connected toward one end to the lift platform 16 thereby effecting two goals. First, hingedly connecting the elongated bar 92 to the lift platform 16 guards against inadvertent separation or loss of the bar 92 relative to the lift assembly 10. Second, hingedly connecting the bar 92 to the lift platform 16 allows the bar 92 to easily and readily assume either of two positions while remaining attached to the lift platform 16. In a first position (illustrated in solid lines in FIG. 13), the bar 92 extends across the open end of the lift platform 16 to limit horizontal shifting movements of the manufactured product from the end of the lift platform 16. In a second position (illustrated in dash lines in FIG. 13), the bar 92 is removed from interfering with horizontal movement of the manufactured product from the lift platform 16.

Figure 13:
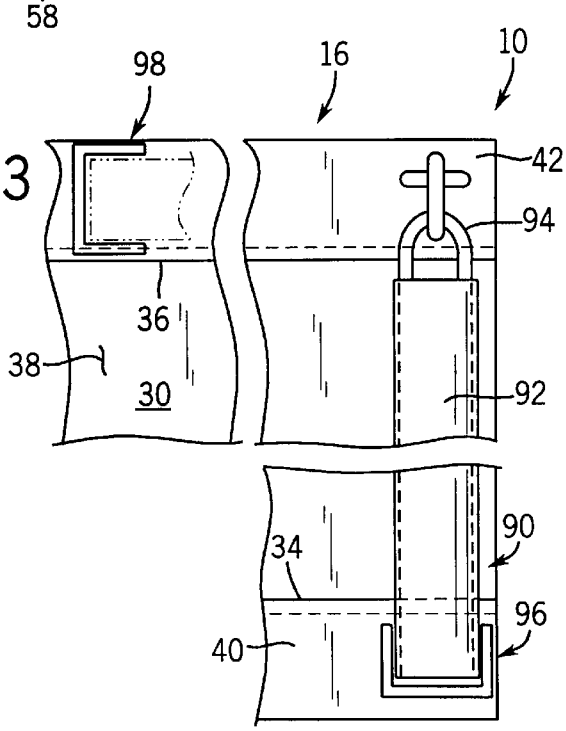
FIG. 13 is an enlarged fragmentary top plan view of a limit stop of the lift assembly of the present invention.

As will be readily appreciated, the hinged connection of the bar 92 to the lift platform 16 can take of any of a myriad of designs without detracting or departing from the scope of the invention. As shown in FIG. 13, bar 92 preferably has an elongated and hollow configuration. In the illustrated embodiment, a chain 94 is endwise inserted through the tube or bar 92 and has one end secured by any suitable means such as welding or the like to the tube 92. An opposite end of the chain 94 is suitably fastened to an upper surface of the flange 42 forming part of the lift platform 16 to allow pivotal movement of the bar 92 relative to the location whereat the chain 94 is articulately fastened to the lift platform 16.

Figure 12:
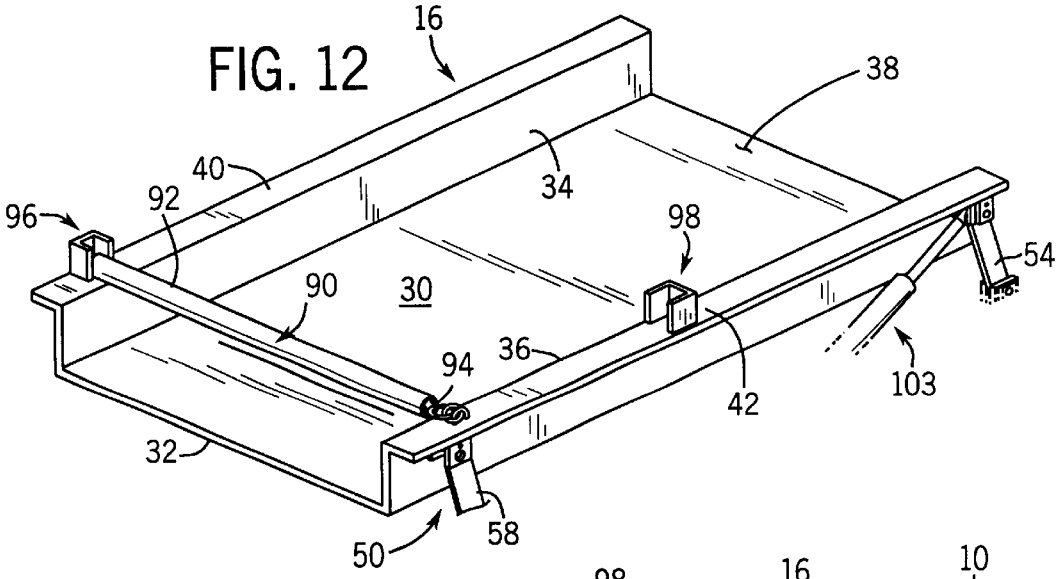
FIG. 12 is a perspective view of the lift platform forming part of the lift assembly of the present invention.

Flange 40 of the lift platform 16 is preferably provided with an open top bracket 96 for accommodating and releasably holding the free end of the bar 92 in the first position (FIGS. 12 and 13). A similarly shaped open top bracket 98 is preferably arranged on the flange or extension 42 of the lift platform 16 in spaced relation from the location whereat the bar 92 is hingedly connected to the lift platform 16. Bracket 98 is configured to accommodate and releasably hold the free end of the bar 92 in the second position (FIG. 13).

Figure 14:
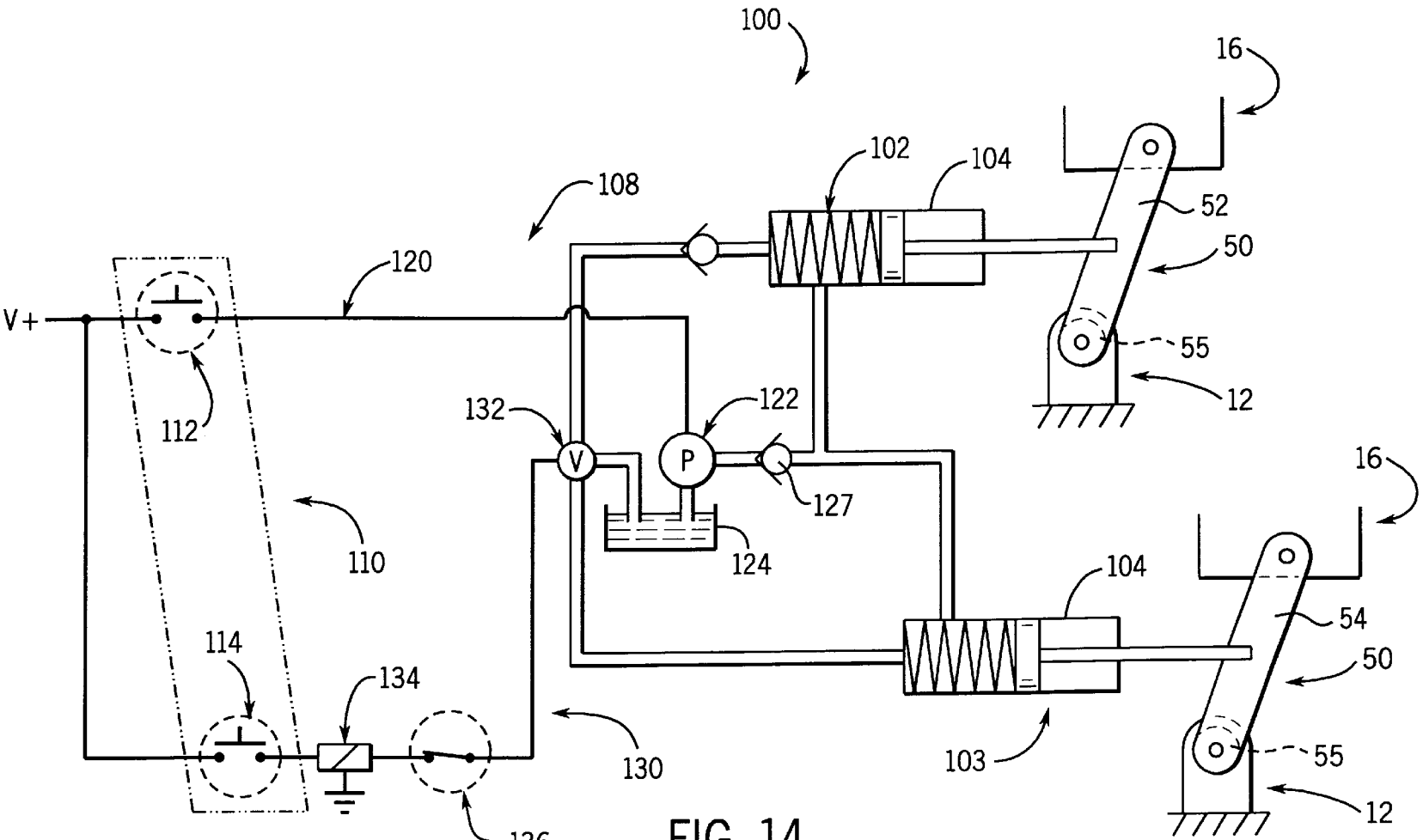
FIG. 14 is a schematic diagram of an electro/hydraulic system operable in combination with the lift assembly of the present invention.

FIG. 14 schematically represents an apparatus 100 provided in combination with the lift assembly 10 for selectively moving or elevating the lift platform 16 between raised and lowered position relative to the base 12. In a preferred embodiment, apparatus 100 includes a pair of linearly distendable/retractable drivers 102 and 103 operably connected between the base 12 and the lift platform 16 for moving the lift platform 16 relative to the base 12 between lowered (FIG. 3) and raised (FIG. 2) positions.

In the illustrated embodiment, drivers 102 and 103 are each configured as a conventional fluid operated cylinder 104. Of course, and as will be appreciated, the drivers 102, 103 can be otherwise configured without detracting or departing from the spirit and scope of the present invention. As shown, the cylinder end of each driver 102, 103 is articulately connected to the base 12. The operative end of each driver 102, 103 is articulately connected to the lift platform 16 as illustrated in FIG. 8. As will be appreciated by those skilled in the art, the torsion bar 55 connected to and extending between the swing arms 52 and 54 promotes substantially equal movements of or movements in unison between the swing arms 52, and 54.

In the illustrated form, and as shown in FIG. 14, drivers 102, 103 of apparatus 100 are preferably operated through circuitry schematically and generally indicated in FIG. 14 by reference numeral 108. The purpose of circuitry 108 is to allow for selective raising and lowering of the lift platform 16 relative to the base 12. In the illustrated embodiment, the circuitry 108 is self-contained and is movable with the lift assembly 10. As shown, circuitry 108 preferably includes a switch assembly 110 which is suitably connected to a suitable source of electrical power V+. The switch assembly 110 preferably includes a manually operated conventional switch 112 for controlling raising movements of the lift platform 16 relative to the base 12 and a manually operated conventional switch 114 for controlling lowering movements of the platform 16 relative to the base 12. Suffice it to say, the switches 112 and 114 of switch assembly 110 can be configured for operation by hand or through a conventional foot operated mechanism.

As shown, switch 112 is operably connected to drivers 102, 103 as through a first electro/hydraulic circuit 120. Because the drivers 102, 103 in the illustrated embodiment are configured as fluid or hydraulically operated, circuit 120 is configured as an electro/hydraulic circuit. Of course, if the drivers 102, 103 of apparatus 100 were electrically operated, circuit 120 can be configured in an electrical format. Suffice it to say, and with respect to the exemplary embodiment illustrated, the first electro/hydraulic circuit 120 operably connects switch 112 to a motor or pump 122 which draws fluid from a reservoir 124 and, in the illustrated embodiment, provides pressurized fluid to the cylinder 104 of each driver 102, 103. Of course, the first circuit 120 is not enabled or operative to operate each driver 102, 103 until the operator of the lift assembly 10 purposefully operates switch 112 to raise the lift platform 16 relative to the base 12.

In the illustrated embodiment, the first circuit 120 further includes check valve structure 127 for inhibiting flow of pressurized fluid from the cylinder 104 of each driver 102, 103 to the motor or pump 122 thereby maintaining pressurization of the cylinder 104 of each driver 102, 103 and, thus, maintaining the lift platform at the elevated or raised height desired for unloading of the manufactured product from the lift assembly 10.

As shown, switch 114 of apparatus 100 is operably connected to the drivers 102, 103 as through a second circuit 130. Again, and because the drivers 102, 103 in the illustrated embodiment are configured as fluid or hydraulically operated, circuit 130 is configured as an electro/hydraulic circuit. Of course, if the drivers 102, 103 of apparatus 100 were electrically operated, circuit 130 can be configured in an electrical format. Suffice it to say, and with respect to the exemplary embodiment illustrated, circuitry 130 preferably includes conventional valve structure 132 for permitting pressurized fluid in the cylinder 104 of each driver 102, 103 to be exhausted in a controlled fashion thereby allowing the lift platform 16 to return to a lowered position whereat the lower surface 32 of the lift platform 16 engages the floor 14 between the members 20, 22 (FIG. 4) of base 12. In the illustrated embodiment, and after pressurized fluid is exhausted from the cylinder 104 of each driver 102, 103, the lift platform 16 returns to a lowered position under the influence of gravity and the weight of the platform 16. Valve structure 132 is suitably configured to provide a smooth or controlled return of the lift platform 16 to a lowered position.

Valve structure 132 is preferably operated under the influence of a solenoid 134 which is operated as through switch 114. When the switch 114 is closed by the operator of the lift assembly to complete the circuit 130, the drivers 102, 103 are operated in a manner allowing the lift platform 16 to return to a lower position relative to the base 12.

In the illustrated form, circuit 130 further includes a normally closed switch or sensor 136 for immediately halting downward movement of the lift platform 16 when an obstacle is detected in the downward path of the lift platform 16. Preferably, switch 136 is configured as a photocell or other suitable detecting apparatus preferably arranged on a mounting bracket 138 (FIG. 4) on the base 12 of the lift assembly 10. When the circuit 130 is completed, and as long as no obstacle is detected by sensor 136 in the downward path of the lift assembly 16, continued downward movement of the lift platform 16 is permitted. As mentioned above, however, when the sensor 136 detects the presence of an obstacle in the downward path of the lift platform 16, downward movement of the lift platform 16 is halted at least until the obstacle is removed thereby effecting completion of the circuitry 130 and continued downward movement of the lift platform 16 relative to the base 12.

A brief summary of the operation of lift assembly 10 will now be provided. When the lift platform 16 is in a lowered position (FIG. 2), the lower surface 32 of the lift platform 16 preferably engages the ground or floor 14 and the support surface 30 of the lift platform 16 is positioned to have manufactured product rolled or wheeled thereonto. As will be appreciated, the narrow width ramp or incline 46 facilitates transference of the wheeled manufactured product from the floor 14 onto the support surface 30 of the lift platform 16. Moreover, the sides 34, 36 of the lift platform 16 inhibit inadvertent lateral movements of the manufactured product beyond predetermined lateral limits. Additionally, and during initial loading of the manufactured product onto the lift platform 16, the pallet P inhibits the manufactured product from inadvertently moving beyond one end of the lift platform 16.

As will be appreciated from an understanding hereof, and during loading of the manufactured product onto the lift assembly 10, structure 90 is pivotally removed from across the open end of the channel 38 defined by the lift platform 16 thereby allowing unobstructed access to the lift platform 16. Preferably, the free end of bar 92 of the apparatus 90 is operably and releasably held by the bracket 98. As such, the structure 90 remains operably associated with the lift assembly 10, thus, guarding against inadvertent separation from the lift assembly 10 and possible loss of the structure 90.

After the manufactured product is loaded or located onto the lift platform 30, the bar 92 of apparatus 90 is rotated about its pivotal connection to the lift platform 16 and is positioned to extend across the open end of the open top channel 38 defined by the lift platform 16; with the free end of the bar 92 being releasably contained within the bracket 96. As such, pallet P inhibit movement of the manufactured product from one end of the lift platform 16 while the bar 92 of apparatus 90 inhibits free movement of the manufactured product loaded onto the lift platform 16 from moving therepast.

After the manufactured product is loaded onto the lift platform 16 and the apparatus 90 is preferably arranged to inhibit manufactured product from inadvertently falling from the loading end of the platform 16, the lift assembly 10 is conditioned to raise or vertically elevate the manufactured product to a height substantially coplanar with the raised or elevated height of the upper support surface of the pallet P. With the lift assembly 10 of the present invention, the manufactured product is elevated within a limited or restricted space with very little horizontal movement being imparted to the manufactured product between the lowered position and the raised position of the manufactured product.

Elevational movement of the manufactured product is effected as through operation of apparatus 100. As explained above, elevational movement of the lift platform 16 is operated simply and easily as through closure of switch 112 thereby completing the first electro/hydraulic circuit 120. Enablement or completion of the electro/hydraulic circuit 120 permits the drivers 102, 103 to forcibly operate the linkage assembly 50 in a manner raising the lift platform 16 to a raised position relative to the base 12. In the preferred form, the support surface 30 of the lift platform 16 moves generally parallel to the base 12 and the floor 14 thereby maintaining stability for the manufactured product as the lift platform 16 moves between lowered and raised positions.

With the present invention, structure 80 maintains the lift assembly 10 in predetermined relation relative to the pallet 10. The plate 82 of apparatus 80 is so arranged relative to the base 12 such that when the lift platform 16 is moved to the raised position relative to the base 12, the platform or support surface 30 is disposed immediately adjacent to the upper support surface of the pallet P so as to easily and readily effect transference of the manufactured product from the lift platform 16 to the upper or raised support surface of the pallet P.

As will be appreciated from an understanding of the preferred form of this invention, the raised or elevated position of the platform is controlled as through the first circuit 120 of apparatus 100. In the illustrated embodiment, the platform 16 of the lift assembly 10 continues to rise until the drivers 102, 103 reach the mechanical limit of their travel. Thereafter, the lift platform 16 is maintained at the selected elevational position until otherwise moved by the operator.

With the lift platform 16 in the elevated position, the manufactured product can readily be transferred to the upper support surface of the pallet P. After the manufactured product is unloaded from the lift platform 16, the operator merely operates switch 114 of the apparatus 100 to return the lift platform 16 to a lowered position relative to the base 12. As mentioned, operation of the switch 114 completes the second circuit 130 leading to and thereby allows operation of the drivers 102, 103 in a manner causing the lift platform 16 to return to a lowered position. In the illustrated form, operation of the switch 114 effects operation of the solenoid valve 132, thus, allowing the cylinder 104 of each driver 102, 103 to exhaust. As pressurized fluid is exhausted from the cylinder 104 of each driver 102, 103, the lift platform 16 moves toward the lowered position under gravity and its own weight. If an object is detected by the sensor 136, however, the solenoid valve 132 automatically changes state and, thus, the lift platform 16 is stopped from further movement until the obstacle or object is removed from beneath the lift platform 16. Once the obstacle is removed, or if no obstacle is detected by sensor 136, the lift platform 16 returns to a lowered position relative to the base 12 and the lift assembly 10 of the present invention is prepared to elevate additional product to the upper raised support surface of the pallet P in the controlled fashion described above.

From the foregoing it will be observed that numerous modifications and variations can be effected without departing from the true spirit and scope of the novel concept of the present invention. It will be appreciated that the present disclosure is intended to set forth an exemplification of the invention which is not intended to limit the invention to the specific embodiment illustrated and described. The disclosure is intended to cover by the appended claims all such modifications as fall within the spirit and scope of the claims.

What is claimed is:

1. A low profile lift assembly, comprising:

a base adapted to rest on a floor, said base including two generally parallel laterally spaced members;

a lift platform interconnected and movable between raised and lowered positions relative to said base, said platform having upper and lower generally parallel surfaces and is configured to fit vertically between the laterally spaced base members such that when said platform is in the lowered position, the lower surface of said platform rests on said floor whereby providing said lift assembly with a low profile; and an apparatus for vertically moving said platform relative to said base.

2. The low profile lift assembly according to claim 1 wherein the upper and lower generally parallel surfaces of said lift platform are separated by a predetermined vertical distance, and wherein said lift assembly further includes a ramp leading from said floor to the upper surface of said lift platform for facilitating movement of articles from said floor to said lift platform and over said vertical distance.

3. The low profile lift assembly according to claim 1 wherein said platform is configured to inhibit horizontal shifting of articles loaded thereonto beyond predetermined lateral limits.

4. The low profile lift assembly according to claim 1 further including structure for inhibiting horizontal shifting of articles loaded thereonto relative to at least one end thereof.

5. The low profile lift assembly according to claim 1 wherein said apparatus for vertically moving said platform relative to said base includes circuitry to selectively raise and lower the lift platform relative to the base.

6. The low profile lift assembly according to claim 1 wherein said circuitry of said apparatus for moving said lift platform relative to said base includes a sensor for effecting movement of said platform relative to said base.

7. A low profile lift assembly for raising product carried on said lift assembly to a vertical elevation generally coplanar with an upper surface of an adjacent pallet onto which said product is to placed, said low profile lift assembly comprising:

a base defined by first and second generally L-shaped rails, with one leg of each rail being arranged in generally coplanar relation relative to each other to define a ground engaging support surface, and with a predetermined distance separating a second leg of said first and second rails;

a lift platform movable between raised and lowered positions relative to said base, said platform having a support surface disposed between opposed vertical sides, said sides being spaced apart to allow said platform to fit vertically within the predetermined distance separating said second legs of said first and second rails of said base such that, when said platform is in the lowered position, a lower surface of said support surface is substantially coplanar with said ground engaging support surface defined by said rails of said base whereby providing said lift assembly with a low profile;

a linkage assembly for operably interconnecting the second leg of each rail of said base with a corresponding vertical side on said platform; and an apparatus for selectively elevating said platform relative to said base.

8. The low profile lift assembly according to claim 7 wherein a predetermined vertical distance separates the support surface and said lower surface of said lift platform from each other, and wherein said base further includes a ramp leading from said ground engaging support surface and the support surface of said lift platform for facilitating transference of articles from ground to said lift platform and over said predetermined vertical distance.

9. The low profile lift assembly according to claim 7 further including structure for releasably interconnecting said lift assembly to said pallet thereby inhibiting shifting movements between said lift assembly and said pallet.

10. The low profile lift assembly according to claim 7 wherein said linkage assembly comprises first, second, third and fourth swing arms, each being pivotally connected at opposed ends to the second leg of each rail of said base and the corresponding vertical side on said platform, respectively.

11. The low profile lift assembly according to claim 10 wherein said first, second, third and fourth linkages are all of substantially equal length whereby allowing said platform to move in direction generally parallel to the ground as the platform moves between the raised and lowered positions.

12. The low profile lift assembly according to claim 7 wherein the vertical sides and said support surface combine to define an open ended channel on said lift platform, and wherein said lift assembly further includes an apparatus for inhibiting articles placed onto said platform for inadvertently and horizontally sliding from at least one end of said channel.

13. The low profile lift assembly according to claim 7 wherein said apparatus for selectively elevating said lift platform relative to said base includes a sensor for effecting lowering movement of said platform relative to said base.

14. The low profile lift assembly according to claim 7 wherein said apparatus for selecting elevating said platform relative to said base includes circuitry allowing for selective raising and lowering movements of said lift platform relative to said base.

15. A low profile lift assembly, comprising:

a base adapted to rest on a floor, said base including two laterally spaced and generally parallel rigid members defining a predetermined distance therebetween, a lift platform having a generally horizontal support surface and two vertical sidewalls which are laterally spaced apart by a distance measuring less than the predetermined distance separating said rigid members of said base to define an elongated open top channel configured to accommodate articles between opposed open ends thereof for vertical movements along with said platform, and wherein, when said lift platform is in a lowered position, a lower side of said platform surface rests on the floor whereby providing said lift assembly with a low profile;

linkage assembly for interconnecting said lift platform to said base for movement generally parallel to said floor; and an apparatus for selectively elevating said lift platform relative to said base.

16. The low profile lift assembly according to claim 15 wherein a predetermined vertical distance separates the generally horizontal support surface and the lower surface of said lift platform from each other, and wherein said base further includes an elongated slanted surface extending upwardly from said floor toward the generally horizontal support surface of said lift platform for facilitating transference of articles from the floor to said lift platform and over said predetermined vertical distance.

17. The low profile lift apparatus according to claim 15 wherein said lift apparatus further includes a bar extending across one end of the channel defined by said lift platform for inhibiting inadvertent horizontal movement of articles loaded onto said lift platform from said one end of the channel.

18. The low profile lift apparatus according to claim 15 wherein said linkage assembly is comprised of four swing arms, with each swing arm being pivotally connected toward one end to a rigid member of said base and pivotally connected toward another end to said lift platform.

19. The low profile lift apparatus according to claim 18 wherein said apparatus for selectively elevating said lift platform relative to said base includes a linearly extendable/retractable hydraulic driver connected at one end to said base and connected toward another end to said lift platform.

20. The low profile lift apparatus according to claim 15 wherein said apparatus for selectively elevating said lift platform relative to said base includes a sensor for effecting lowering movement of said platform a relative to said base.

* * * * *